US010724250B2

(12) United States Patent
Mueller

(10) Patent No.: US 10,724,250 B2
(45) Date of Patent: Jul. 28, 2020

(54) LUXURY LED GLASS WALL

(71) Applicant: Peter Mueller, Edmonton (CA)

(72) Inventor: Peter Mueller, Edmonton (CA)

( * ) Notice: Subject to any disclaimer, the term of this patent is extended or adjusted under 35 U.S.C. 154(b) by 0 days.

(21) Appl. No.: 16/553,177

(22) Filed: Aug. 28, 2019

(65) Prior Publication Data

US 2020/0071936 A1 Mar. 5, 2020

Related U.S. Application Data

(60) Provisional application No. 62/723,480, filed on Aug. 28, 2018.

(51) Int. Cl.

| | |
|---|---|
| ***E04F 13/14*** | (2006.01) |
| ***F21V 23/06*** | (2006.01) |
| ***F21S 4/24*** | (2016.01) |
| ***F21Y 115/10*** | (2016.01) |

(52) U.S. Cl.

CPC ..... *E04F 13/145* (2013.01); *F21S 4/24* (2016.01); *F21V 23/06* (2013.01); *F21Y 2115/10* (2016.08)

(58) Field of Classification Search

CPC ..... E04F 13/144; E04F 13/145; F21S 4/24; F21V 23/06; F21Y 2115/10

See application file for complete search history.

(56) References Cited

U.S. PATENT DOCUMENTS

| | | | | |
|---|---|---|---|---|
| 5,069,014 | A * | 12/1991 | Kubbutat | E04F 13/0812 52/235 |
| 7,549,784 | B1 * | 6/2009 | Teeters | F21V 23/06 362/145 |
| 10,067,285 | B1 * | 9/2018 | Zheng | E04C 2/365 |
| 2009/0094734 | A1 * | 4/2009 | Diebel | E04H 4/0043 4/506 |
| 2014/0301072 | A1 * | 10/2014 | Park | F21V 5/06 362/235 |

* cited by examiner

*Primary Examiner* — Peggy A Neils

(57) ABSTRACT

Luxury gemstone-style glass wall including a LED background light module installed within a framing module and covered with a glass module. The wall frame module is installed into a construction frame wall. The LED module includes strips of programmable LED lights mounted on an aluminum rear panel with high-shine aluminum facing in a frame that attaches, in the wall frame module. The glass module includes a plethora of glass pebbles held together and attached to another clear sheet with a non-yellowing resin. The LED lights shine through the glass pebbles to create a variety of lighting effects that can be used to create visual interest, set the mood, or provide light therapy.

17 Claims, 14 Drawing Sheets

LUXURY LED GLASS WALL

CROSS-REFERENCE TO RELATED APPLICATION

The present application is related to and claims priority from prior provisional application Ser. No. 62/723,480, filed Aug. 28, 2018 which application is incorporated herein by reference.

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of wallboard paneling and more specifically relates to a luxury gemstone-style glass wall comprising a LED background light that can be easily installed almost anywhere.

2. Description of the Related Art

When you're designing your décor, don't settle for the same boring style that everyone else is using. Glass is a non-crystalline amorphous solid that is often transparent and has widespread practical, technological, and decorative usage in, for example, windowpanes, tableware, and opto-electronics. The most familiar, and historically the oldest, types of glass are "silicate glasses" based on the chemical compound silica (silicon dioxide, or quartz), the primary constituent of sand. Unfortunately standard glass is clear and does not allow a user to customize different gemstones or colors.

Various attempts have been made to solve problems found in wallboard paneling art. Among these are found in: U.S. Pat. No. 9,239,163 to Matthew Alan Barry; U.S. Design Patent No. D632405 to Elizabeth Egan Metcalf; U.S. Pat. No. 5,348,582 to Herzig et al.; U.S. Pat. No. 2,221,890 to Williams Findley; and U.S. Pub. No. 2011/0268921 to Canales et al. This prior art is representative of backlight tile and decorative wallboard paneling.

None of the above inventions and patents, taken either singly or in combination, is seen to describe the invention as claimed. Thus, a need exists for a reliable Luxury LED Glass Wall glass pebble ocean blue walling structured and arranged to be used in shower walling or other luxury environments comprising lighting means such as LED lights and to avoid the above-mentioned problems.

BRIEF SUMMARY OF THE INVENTION

In view of the foregoing disadvantages inherent in the known wallboard paneling art, the presently claimed invention provides a novel Luxury LED Glass Wall. The general purpose of the presently claimed invention, described subsequently in greater detail, is to provide luxury gemstone-style glass wall having a LED background light that can be easily installed almost anywhere. The features of the invention that are believed to be novel are particularly pointed out and distinctly claimed in the concluding portion of the specification. These and other features, aspects, and advantages of the presently claimed invention will become better understood with reference to the following drawings and detailed description.

BRIEF DESCRIPTION OF THE DRAWINGS

The figures that accompany the written portion of this specification illustrate embodiments and method(s) of use for the presently claimed invention, Luxury LED Glass Wall, constructed and operative according to the teachings of the presently claimed invention.

The various embodiments of the presently claimed invention will hereinafter be described in conjunction with the appended drawings.

DETAILED DESCRIPTION

As discussed above, embodiments of the presently claimed invention relate to wallboard paneling with LED background lights, and more particularly to a luxury LED Glass Wall. Made from the finest glass pebbles, Luxury LED Glass Wall capture the look of precious gemstones, including amber, amethyst, emerald, gold, ruby, sapphire, diamond and tourmaline. It's the simple way to enrich and beautify any space, from an eye-catching backsplash in a kitchen, to a dramatic decorative wall in an office, to a statement shower or bath. With Luxury LED Glass Wall, you can easily add an elegant flair to any environment and customize the look to fit your lifestyle.

Figure 1:
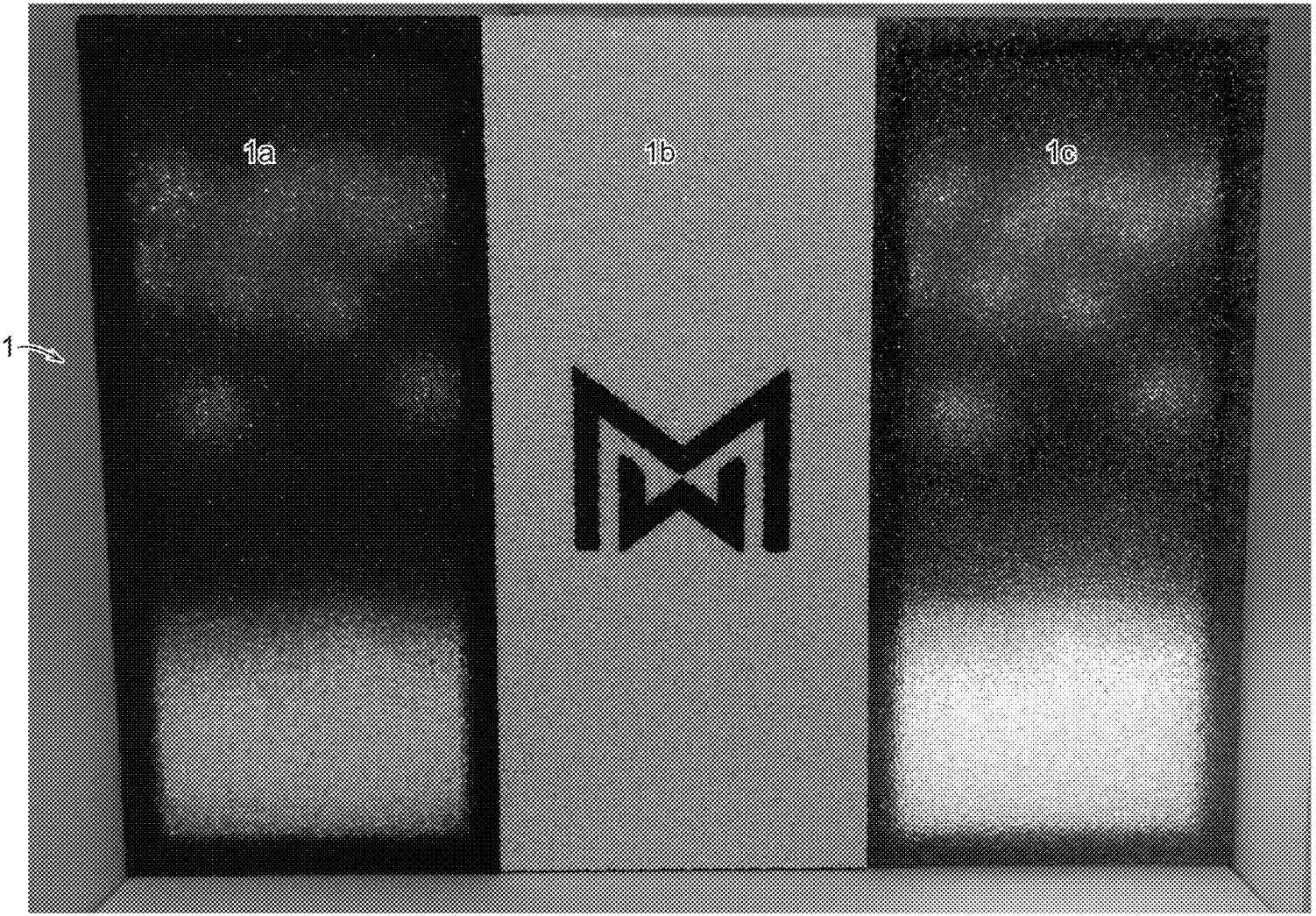
FIG. 1 shows a perspective views illustrating a Luxury LED Glass Wall according to an embodiment of the presently claimed invention.
Figure 2:
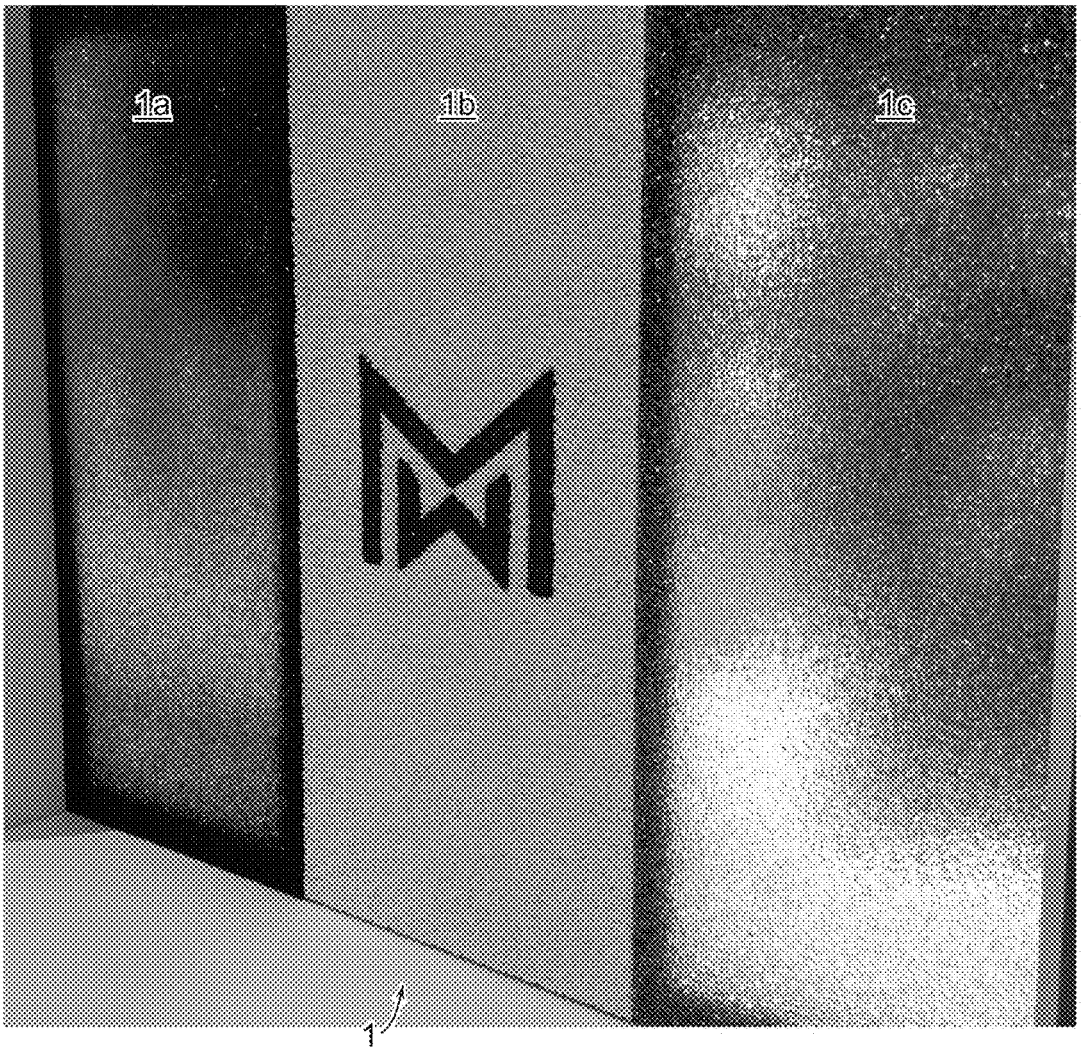
FIG. 2 shows another perspective view illustrating a Luxury LED Glass Wall according to an embodiment of the presently claimed invention.
Figure 3:
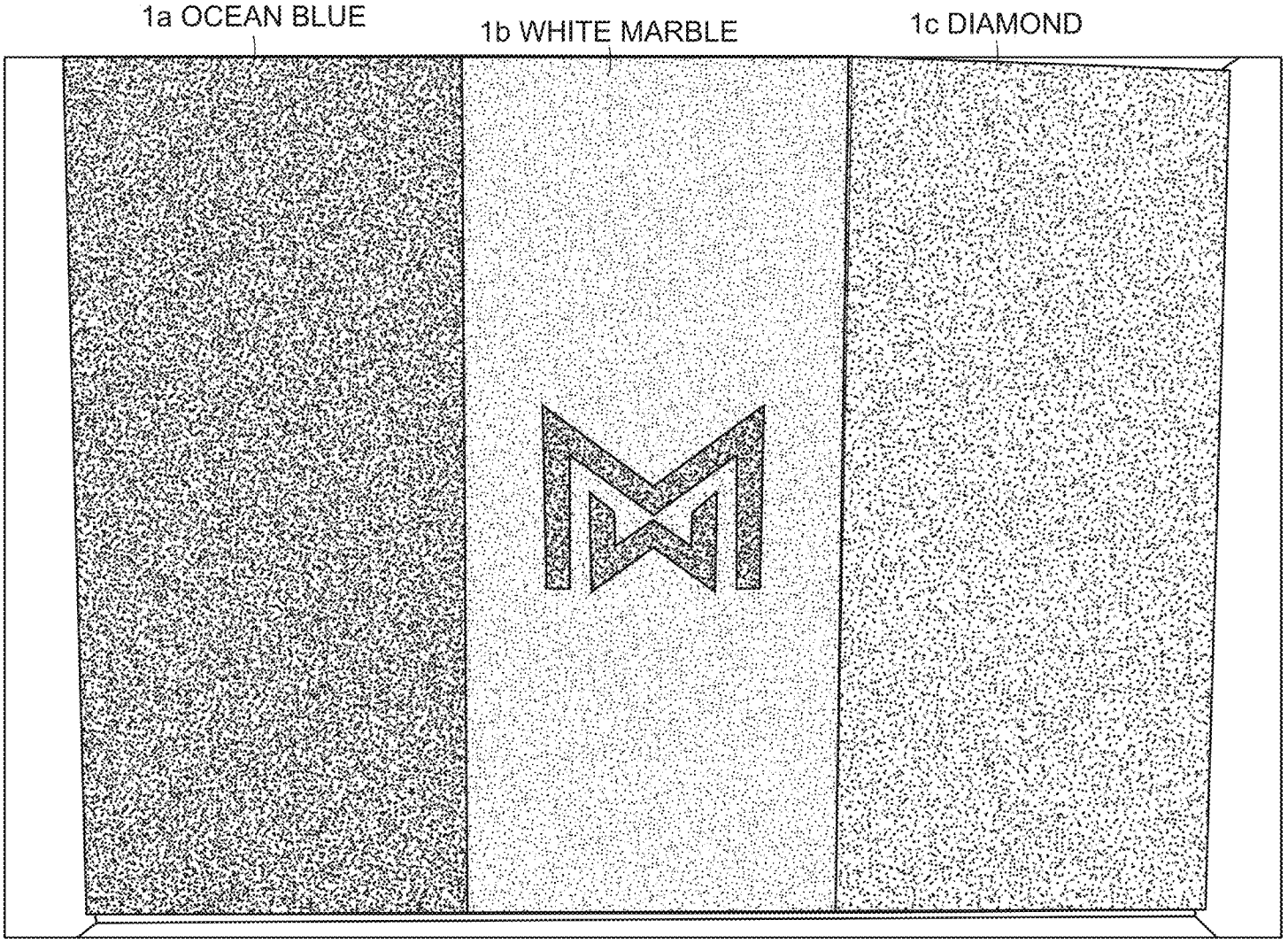
FIG. 3 shows a perspective view illustrating a Luxury LED Glass Wall according to an embodiment of the presently claimed invention.

Easy to Use and Packed with Features and Benefits:

- High quality glass pebbles imported from Germany
- Each wall is customizable and unique
- Different lighting sequences available
- Click-into-place design allows for easy maintenance
- Installs flush with surrounding walls for a seamless transition
- Variety of designs, colors and sizes available
- Uses include bathrooms, kitchens, entrance hallways, commercial buildings and more Referring now to the drawings, FIGS. 1 and 2 illustrate perspectives of the luxury LED Glass Wall, a novel product offering consumers a practical solution to the aforementioned challenges. As the name implies, the luxury LED Glass Wall is formed from a specially designed luxury gemstone-style glass module 1 with a LED background light module 200 that creates different lighting effects, all set in a wall frame module 100. A number of different panel versions of the glass module 1, including but not limited to ocean blue 1*a*, white marble 1*b*, and diamond 1*c*, are available to create the different lighting effects. FIG. 3 illustrates these glass module 1 panel versions 1*a*, 1*b*, 1*c* without the LED background light.

Figure 4A:
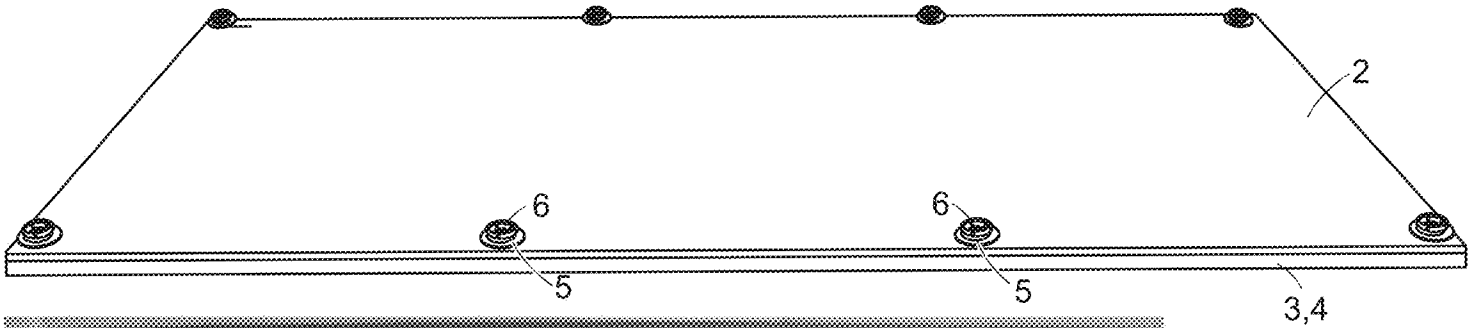
FIGS. 4A and 4B show a perspective view illustrating a glass pebble panel according to an embodiment of the presently claimed invention.
Figure 4B:
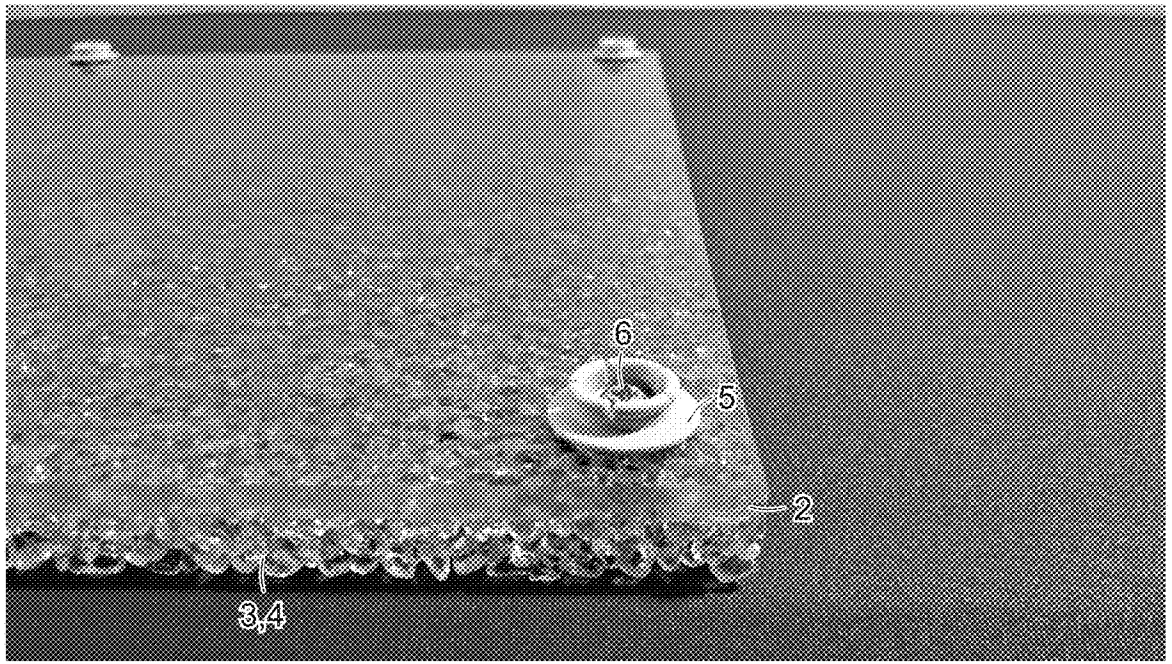

As show in FIGS. 4A and 4B, the glass module 1 is a panel that serves as a visible and exposed cover for a wall. The glass module 1 is both functional and decorative, providing insulation and sound protection, combined with a modern and impressive appearance and the number of different variations shown in FIGS. 1-3.

The glass module 1 is formed from a clear plastic plate 2. The clear plastic plate 2 is preferably made of acrylic, but other clear plastics, such as acrylonitrile butadiene styrene (ABS), expanded polyvinyl chloride (PVC), high-density polyethylene (HDPE), or polyethylene terephthalate (PETG) such as the VIVAK® PETG sheet, may be used so long as they provide sufficient support to meet the structural requirements and conditions. The clear plastic plate 2 serves as a base plate for the glass stones 3. The glass stones 3 are glass pebbles in gemstone quality, such as those imported from Germany, that form the glass module 1.

The binder S140 (a Germany import) 4 is transparent, low-yellowing, solvent-free, 2-component resin, such as an epoxy/amine resin. The binder S140 4 is mixed in a certain mixing ratio with the desired type of stone 3 and applied to the specially processed base plate 2 to create the pebbled part 3, 4 on top of the clear plastic plate 2.

The glass module 1 is mounted into the wall frame module 100 by a mounting system. The mounting system includes a number of low profile male clip 5, such as the Fastmount VL-M3FR very low profile male clip, attached to the plastic plate 1 by screws 6, such as the Fastmount VL-SS3 very low profile stainless steel screw, and glued with epoxy. The VL-M3FR clip is fire rated and has a 10 KG pull out load per clip set. The mounting system 5, 6 is installed on the baseplate according to the manufacturer's guidelines, but at least six clip and screw sets are preferable for an average sized panel.

Designed for use at sea, land and air, Fastmount offers a variety of features and benefits:

- No visible fixings.
- Eliminates panel damage—install panels during final build stages.
- Variety of mounting options—self tapping, glue and screw fix.
- Allows for panel flex and expansion.
- Provides cavities for services and enhanced acoustics.
- Shorter downtime for clients during refit.
- Ceiling, walls, feature panels, furniture and upholstery.
- Interior and selected exterior applications.
- Mounts into a wide variety of substrates e.g. GRP, composite, honeycomb, aluminum.
- New build, refit and upgrades.

The Fastmount panel mounting system is preferred, as with Fastmount interior linings can be removed and reassembled at any time and in any order, but any equivalent commercially available mounting system will work.

A sealing tape 7 is optionally mounted all around the front of the wall frame module 100, thus ensuring a dust and moisture barrier. The 3M Sealing Tape range is designed for demanding applications where sealing and insulation are required, and thus is preferred, but any equivalent commercially available sealing tape will also work. The sealing tape 7 is optionally applied based on the structural rules and circumstances require additional sealing and insulation, such as when installing a luxury LED glass wall in a shower.

Figure 5:
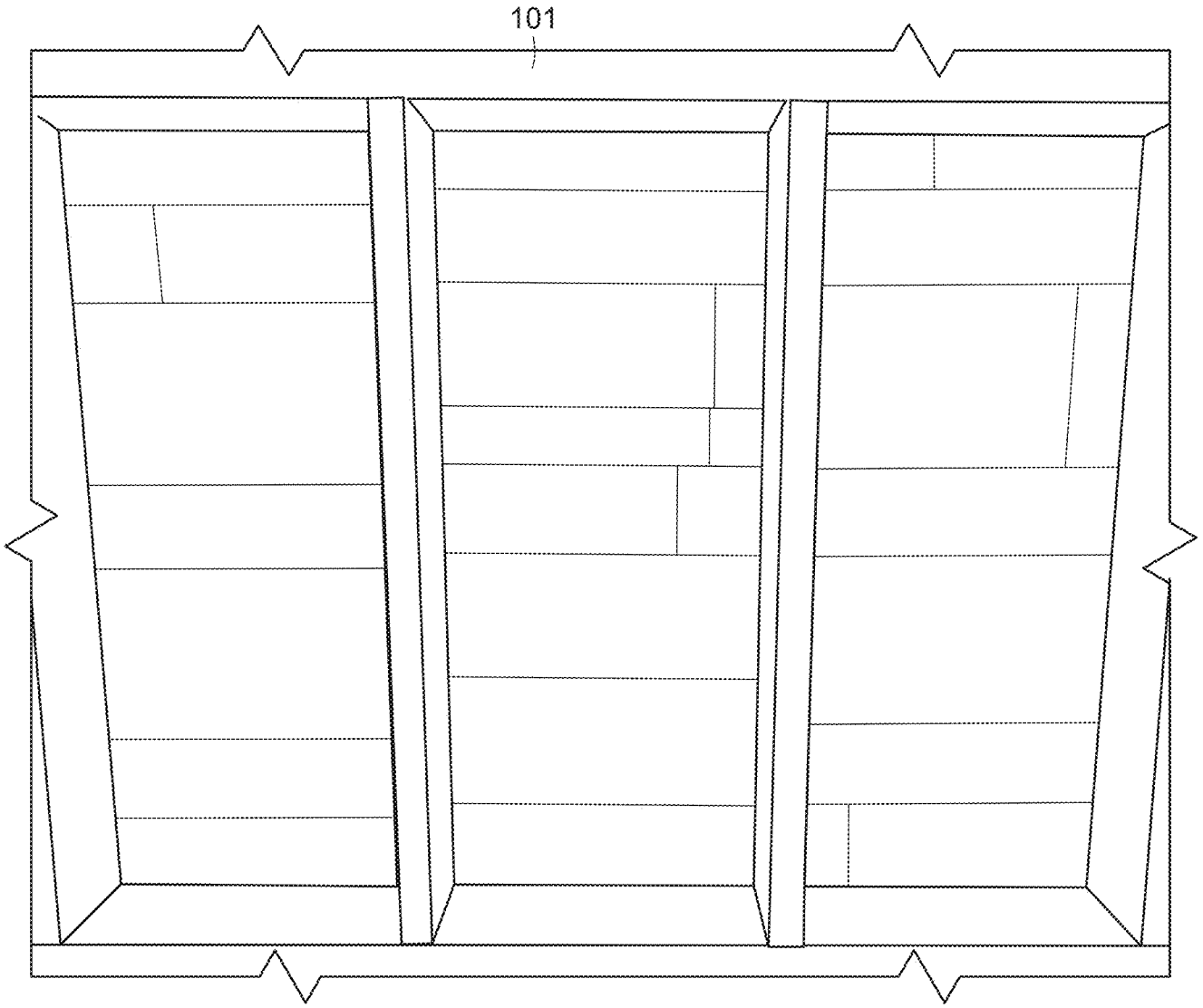
FIG. 5 shows a perspective view illustrating a construction wall framing structure suitable for installing a luxury LED glass wall according to an embodiment of the presently claimed invention.
Figure 6:
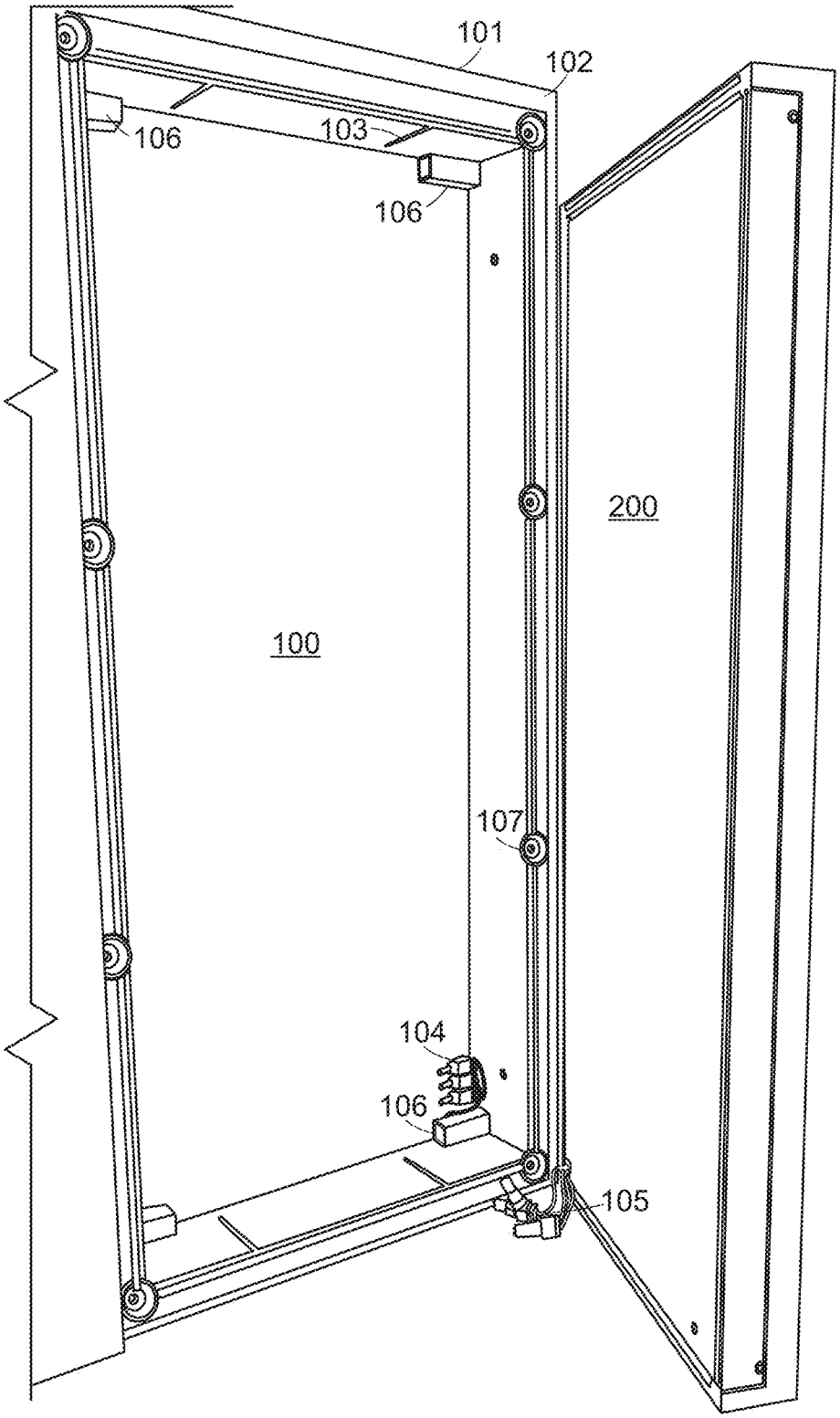
FIG. 6 shows a perspective view illustrating a frame module according to an embodiment of the presently claimed invention.

As shown in FIGS. 5 and 6, the wall frame module 100 is mounted into a construction wood-framed wall 101 built. As shown in FIG. 5, the framing 101 preferably has a width of 16 inches on center and a height of 36 inches on center, per panel. Any suitable framing wood will work to build the studs, but 2×6 inch cedar wood is preferred.

As shown in FIG. 6, the wall frame module 100 is designed to support and protect the LED modules, as well an easy insertion and connection. The wall frame module 100 with internal slots 103 arranged horizontally and vertically, as well an integrated LED DC power and signal supply socket 104 built-in on the wall frame module. The DC power and signal supply socket 104 connects to a connector 105 attached to the LED module, and can be any suitable power and signal supply socket, such as a 5.5×2.1 mm male DC jack power and signal connector designed for LED strips. The connector 105 can be any compatible connector, such as a 5.5×2.1 mm female DC jack power and signal connector designed for LED strips.

The wall frame module 100 can be made of a plastic, such as acrylic, ABS, PVC, HDPE, or PETG, aluminum, or another appropriate material using various processing methods such as gluing, welding, thermoforming, vacuum forming. The material, shape and size of the wall frame module 100 can be adjusted according to the building regulations and conditions and desired size of the finished luxury LED glass wall. The wall frame module connects to the mounting system 5, 6 of the glass module 1 with the female clips 107 and screws 6 that match the male clips 5 on the glass module 1. The female clips 107 can be any compatible clip, such as the Fastmount VL-F3FR very low profile female clip. The female clip 107 should be fire rated and have a 10 KG pull out load per clip set.

Figure 7:
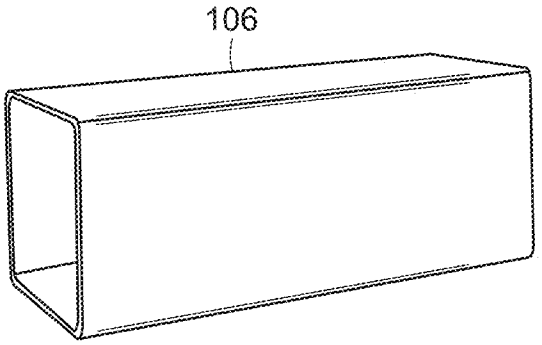
FIG. 7 shows a perspective view illustrating a metal spacer for a LED module according to an embodiment of the presently claimed invention.

LED Modules 200 can be used in combination, so multiple LED modules 200 can be slotted into the wall frame module 100 and programmed together to operate singularly or individually. This way LED modules 200 can be manufactured remotely and sent to installation site and slotted in as needed for custom wall size requirements. The wall frame module 100 contains aluminum spacers 106 to space the LED modules 200. As shown in FIG. 7, the aluminum spacers 106 are hollow metal rods with four sides that can be used to space the LED modules 200 wherever necessary.

The wall frame module 100 is available according to the structural conditions in two versions:

With a circumferential ninety-degree edge on the front including an integrated panel mounting system such as the Fastmount panel mounting system.

Without a circumferential ninety degree front edge. This option allows for a more flexible, customized installation of the frame module and the panel mounting system, as well as the glass module.

Figure 8A:
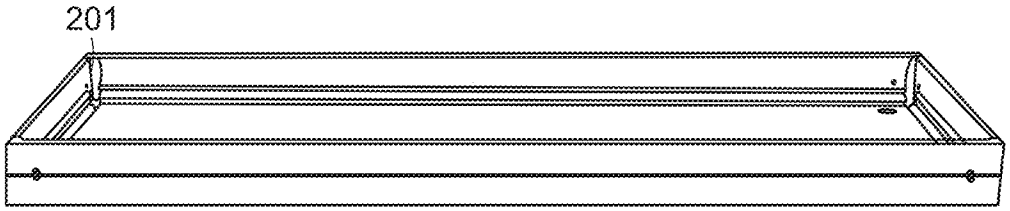
FIGS. 8A and 8B show a perspective view illustrating an metal frame for the LED lights according to an embodiment of the presently claimed invention.
Figure 8B:
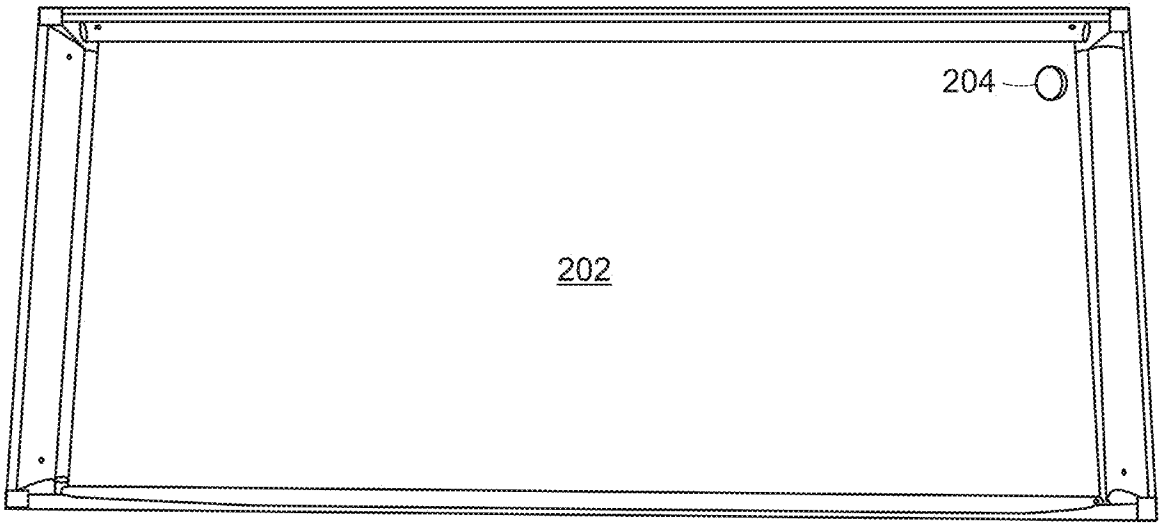

FIGS. 8A and 8B show a background lighting for the glass module, the LED module 200. The LED module 200 serves as a special light source and for creating unique lighting effects. The LED light module 200 has a number of components, including a frame 201 preferably made of aluminum, a rear panel 202 also preferably made of aluminum, one or more flexible LED light strips 203 mounted on a rear panel 202, preferably with high-shine aluminum facing, one more performance rubber grommets 204 to protect cables or wires from sharp corners and edges, the connector 105 for the low voltage LED power and signal plugs and any necessary cables. As discussed below, the exact electronic components may vary depending on customer request. The frame profile 201 and the rear panel 202 are preferably made of aluminum. The aluminum may optionally be a sheet with a core of non-toxic polyethylene (PE) between two aluminum rolls, and be coated with a protective film such as IDEABOND/OME, polyvinylidene fluoride (PVDF), macromolecular lamination film, or any combination of the above. The aluminum may also have a number of coatings for aesthetics, such as solid colors, metallic, high gloss, pearl, spectra mirror, stone-look, wood-look, or brushed. Preferably, the rear panel will include a PE core, with an aluminum skin on one side that has been coated with an aesthetic coating, and an aluminum skin on the other side that has a pretreatment layer, a primer, a PVDF top coat, and protective film layered thereon.

The frame 201 is preferably 56 mm in height, 15 mm in width, and can have any length necessary/desired by the installer. The surface of the frame 201 preferably has been treated with anodic oxidation, or electrostatic powder spraying, or both anodic oxidation and electrostatic powder spraying. The rear panel 202 is preferably 3 mm thick, and is sized to fit the frame 201. The clear front panel 205 can be any clear material that meets the structural requirements and conditions, such as the VIVAG PETG clear sheet, an acrylic sheet, an expanded PVC plastic sheet, a HDPE plastic sheet, a PETG sheet, or an ABS plastic sheet. The clear front panel 205 is preferably 3 mm thick, and is sized to fit the frame 201. The flexible LED light strips 203 can be any commercially available LED light strips that have programmable pixels, full color, and 60 LEDs per meter. One suitable commercial available flexible LED light strip is the WS2812B DC 5V/12V series.

Figure 9:
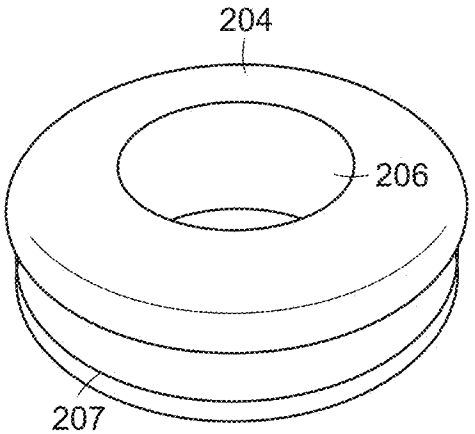
FIG. 9 shows a perspective view illustrating a performance rubber grommet according to an embodiment of the presently claimed invention.

As shown in FIG. 9, the performance rubber grommet(s) 204 has a round center opening 206, and a cutout 207 around the circumference to hold it in place on any necessary material, such as the rear panel 202.

Figure 10:
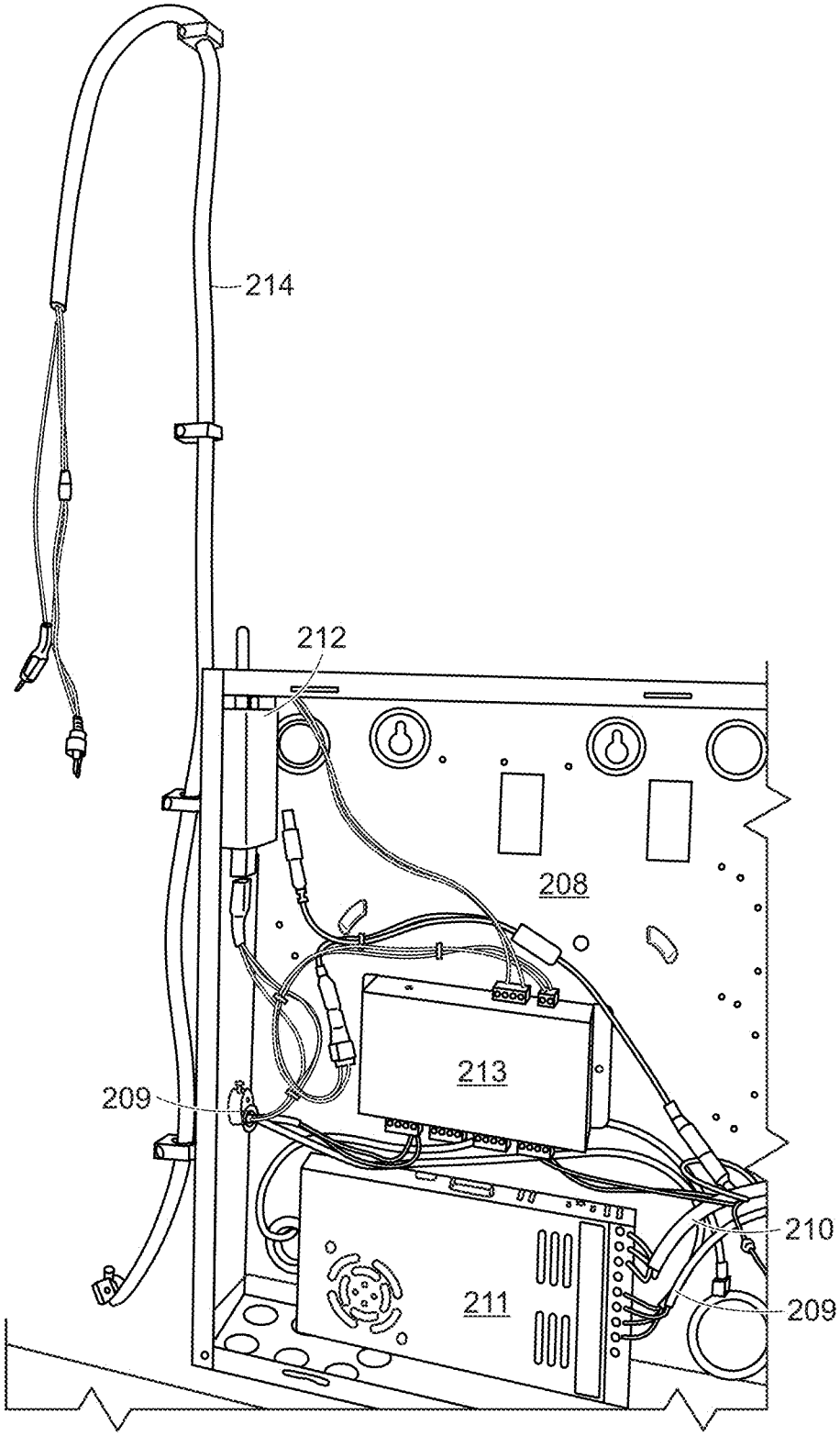
FIG. 10 shows a perspective view illustrating a power supply panel according to an embodiment of the presently claimed invention.

As shown in FIG. 10, power is supplied via the external electrical power network 208. The connection options are aimed at the structural regulations and conditions, and include direct connection 209 to the power supply panel 208, connection between the power supply panel 208 and an existing power circuit 210, a power supply/driver 211, a Wi-Fi controller 212 to allow the lighting to be controlled by a portable electronic device 300, such as a smartphone, tablet, remote control, or digital assistant, over Wi-Fi, and a signal output/data signal amplifier 213 for the programmable LED light strips 203, and all associated cables, such as an optional stereo audio aux cable 214.

The power supply/driver 211 can be any suitable commercially available power supply/driver, such as the DC5V-DC12V/AC110-240 Volt Switching Power Supply/Driver, or the Mean Well LRS-350-5 DC 5V 350 W 70 A UL certification AC 110-240 volt switching power supply for LED strip lights. The stereo audio aux cable 214 can likewise be any suitable commercially available cable, such as a 3.55 male-to-female stereo plug/2RCA plug cable.

The controller 212 allows lighting to be controlled via a portable electronic device 300, such as a smartphone or tablet, remote control, or digital assistant, over Wi-Fi, with hundreds of color sequences, as well as allowing for the light display to be coordinated with music playback through the audio output device using the stereo audio aux cable 214. Once suitable controller 212 is the DC7-24V, Newest LED WIFI Dream Color Music Spectrum DMX Stepped Controller, Controlling Smart Portable Electronic Device, for WS2812B, Addressable LED Lights. One suitable signal output/data signal amplifier 213 is the DC12V, 8-channel SPI signal output data signal amplifier for programmable dream color LED light strips.

The LED background lighting module 200 is switched on and off via a separately installed light switch 301, such as a Wi-Fi switch. Between the light switch and LED module 200, the DC5V-DC12V/AC110-240 volt switching power supply/driver 211 is interposed to generate the DC power supply of the LED light strips, the controller and the signal amplifier.

Figure 11:
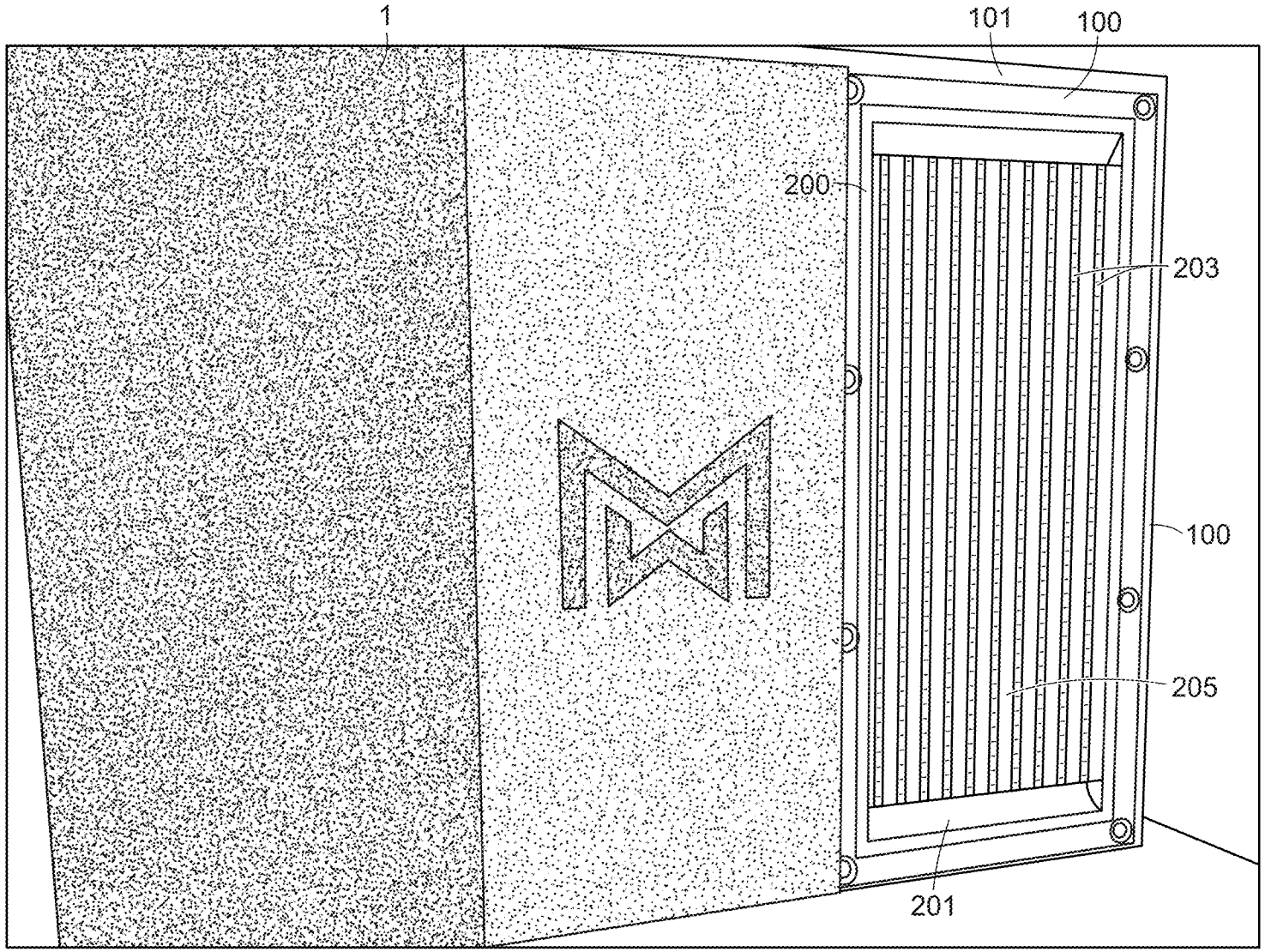
FIG. 11 shows a perspective view illustrating a LED module installed in a frame module according to an embodiment of the presently claimed invention.
Figure 12:
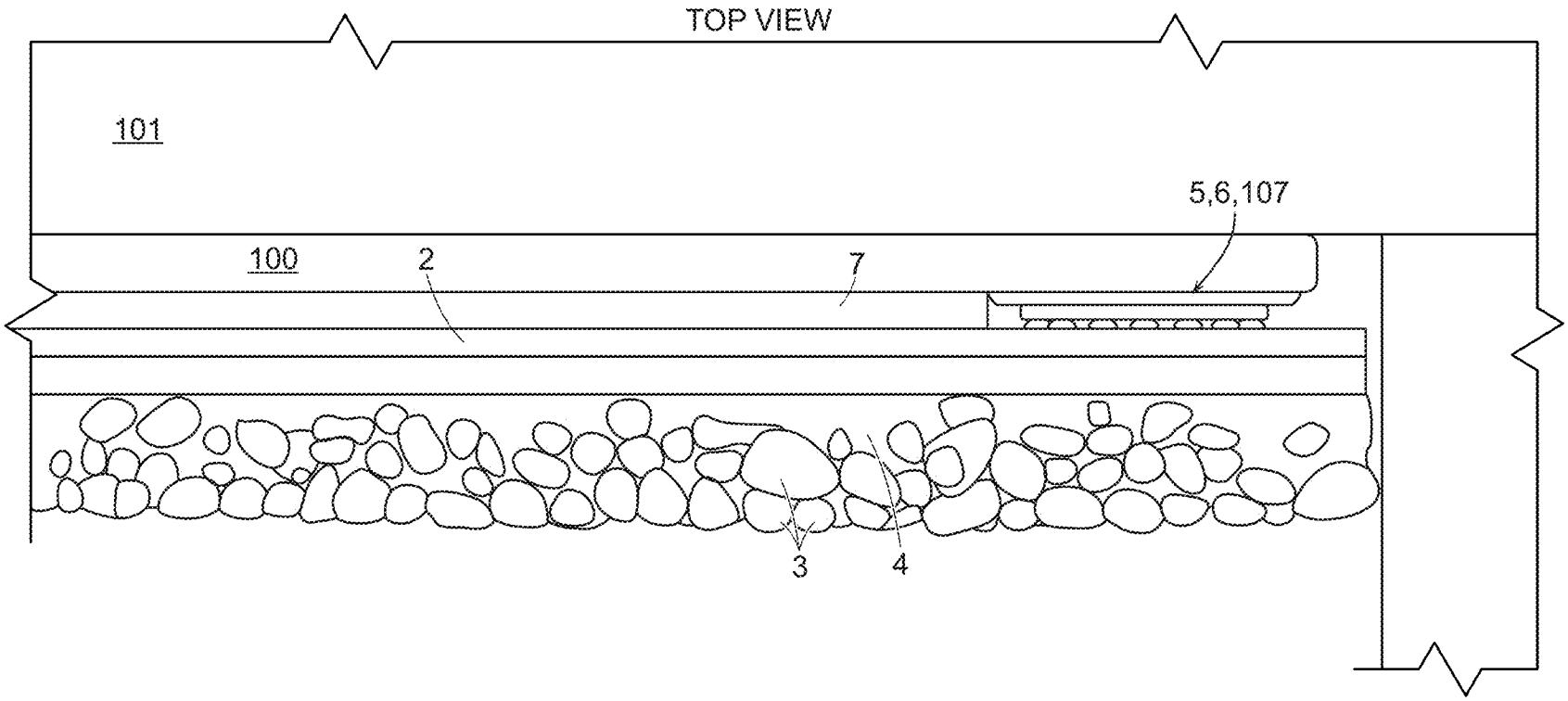
FIG. 12 shows a top view illustrating a Luxury LED Glass Wall according to an embodiment of the presently claimed invention.

As shown in FIGS. 11-12, the LED module 200 with the LED strips 203 attached is mounted inside the wall framing module 100, which is located in the construction wood-framed wall 101. The glass module 1 is mounted in front of the LED module 200 so that it completely covers it, with the clear plate 2 closest to the wall frame module 100 and the glass pebbles 3 attached with resin 4 on the outside. The sealing tape 7 is between the clear plate 2 and the wall frame module 100.

Figure 13:
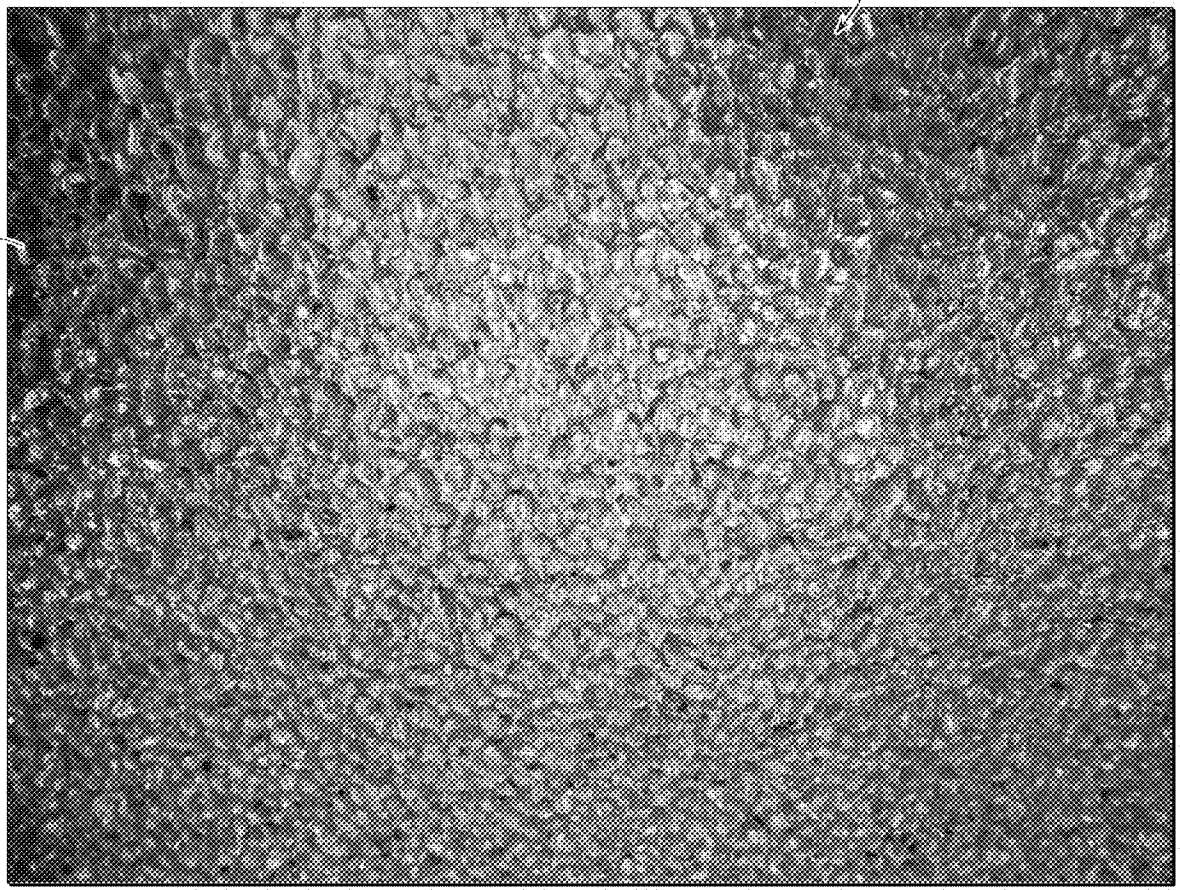
FIG. 13 illustrates an ombre color effect that can be produced on the luxury LED glass wall according to an embodiment of the presently claimed invention.
Figure 14:
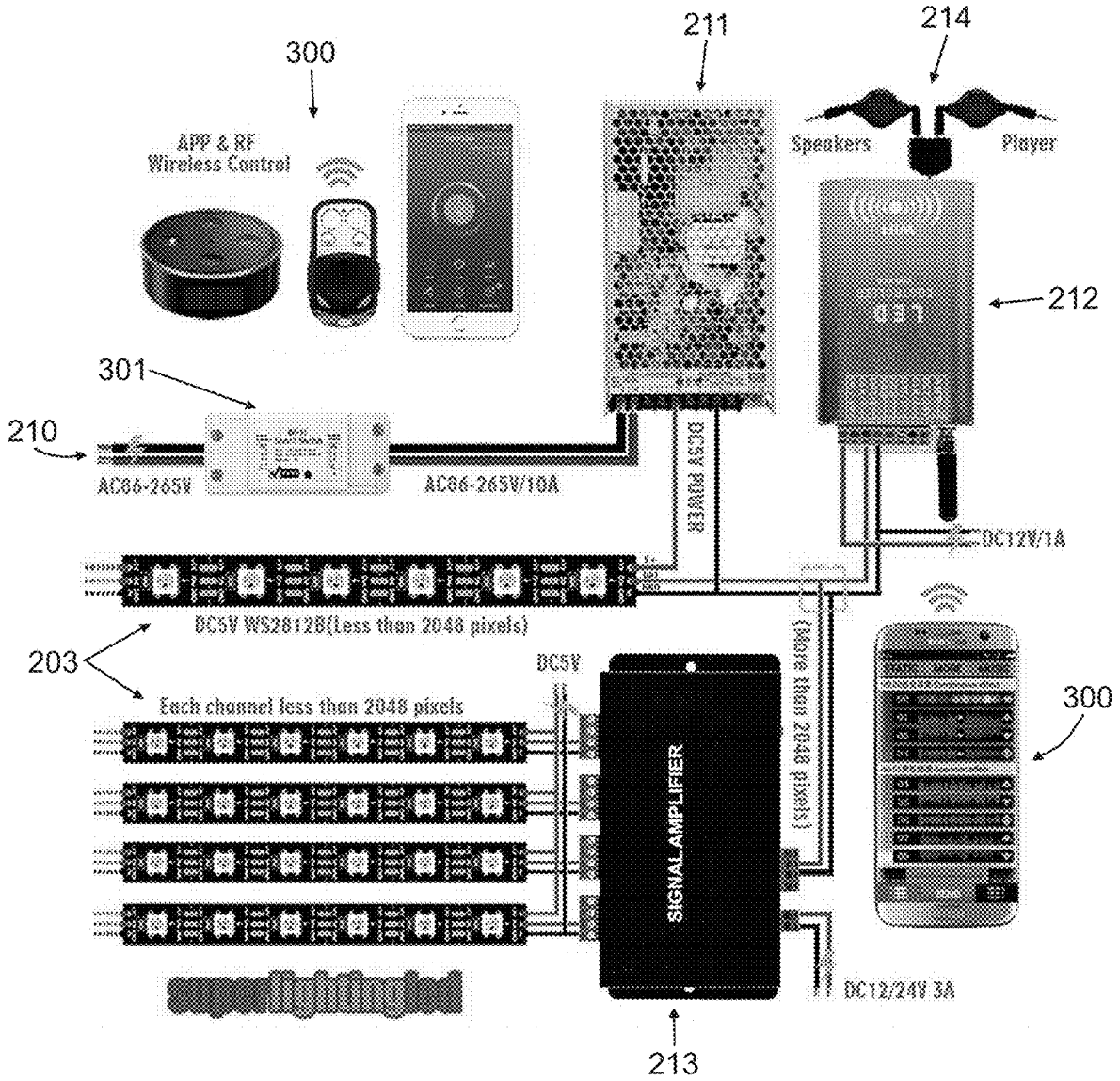
FIG. 14 illustrates a connection diagram for electronic components according to an embodiment of the presently claimed invention.

As shown in FIG. 13, the LED module(s) 200 can create complex color patterns through the glass module 1, such as an ombre effect.

The embodiments of the invention described herein are exemplary and numerous modifications. Variations and rearrangements can be readily envisioned to achieve substantially equivalent results, and all such equivalents are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claim:

1. A LED backlight and decorative wallboard paneling comprising:

(a) a glass module having (i) a clear plastic plate;

(ii) a plethora of pebbles comprising a material selected from the group consisting of glass stones, acrylic stones, marble stones, and gem stones; and (iii) a resin, wherein the resin is transparent, low-yellowing, and solvent-free, wherein the resin is mixed with the plethora of pebbles and applied to the clear plastic plate to form the glass module;

(b) one or more LED modules having
- (i) a frame;
- (ii) a rear panel;
- (iii) a clear front panel;
- (iv) one or more flexible LED strips comprising light-emitting diode bulbs, wherein the one or more flexible LED strips are mounted on a rear panel;
- (v) one or more DC power and signal supply connectors; and
- (vi) one or more performance rubber grommets operably connected to the rear panel to protect cables and wires from sharp corners and edges;

(c) an external electrical power supply panel having
- (i) a power supply or driver;
- (ii) a connector operably connected to the power supply or driver and the one or more flexible LED light strips;
- (iii) a signal output amplifier operably connected to the one or more flexible LED light strips; and
- (iv) a Wi-Fi controller operably connected to control the flexible LED light strips via a portable electronic device, wherein the portable electronic device is a smartphone or a tablet;
- (v) a stereo audio aux cable operably connected to the controller and an audio output device to provide music spectrum effects;
- (vi) a wiring system operably connected to the electric power supply panel and connectable to an external light switch so that the light switch turns the LED light strips on and off;

(d) a wall frame module having
- (i) internal slots arranged horizontally and vertically;
- (ii) one or more LED DC power and signal supply socket integrated within the wall frame module;
- (iii) four or more low profile female clips;
- (iv) one or more aluminum spacers to space the LED modules within the wall frame module; and (e) a mounting system including
- (i) four or more low profile male clips attached to the clear plastic plate by one screw per each male clip and an epoxy glue; and
- (ii) the four or more low profile female clips attached to the wall frame module by one screw per each female clip and the epoxy glue;

wherein the female clips and the male clips connect together to firmly attach the glass module to the wall frame module, forming sets of male and female clips with one male clip and one female clip per set, wherein the one or more LED modules are located within the wall frame module, wherein the frames of the one or more LED modules slot into the internal slots arranged in the wall frame module.

2. The LED backlight and decorative wallboard paneling according to claim 1, wherein the mounting system further comprises a sealing tape operably mounted to the front of the wall frame module to form a dust and moisture barrier between the glass module and the wall frame module that protects the LED module.

3. The LED backlight and decorative wallboard paneling according to claim 1, wherein each set of male and female clips has at least a 10 KG pull out load.

4. The LED backlight and decorative wallboard paneling according to claim 1, wherein the aluminum spacers are hollow aluminum rods with four sides.

5. The LED backlight and decorative wallboard paneling according to claim 1, wherein the wall frame module has a circumferential ninety-degree edge on the front.

6. The LED backlight and decorative wallboard paneling according to claim 1, wherein the one or more flexible LED light strips have programmable pixels, full color, and at least sixty LED bulbs per meter.

7. The LED backlight and decorative wallboard paneling according to claim 1, wherein each of the performance rubber grommets has a round center opening and a cutout around the outer circumference to hold the grommet in place on the rear panel.

8. The LED backlight and decorative wallboard paneling according to claim 1, wherein the external electric power supply panel further comprises a LED controller operably connected to allow the lighting to be turned on and off and the color set over Wi-Fi from the portable electronic device.

9. The LED backlight and decorative wallboard paneling according to claim 1, wherein the external electric power supply panel further comprises a stereo audio aux cable operably connected to the controller and an audio output device to allow a light display to be coordinated with music playback through the portable electronic device.

10. The LED backlight and decorative wallboard paneling according to claim 1, wherein the LED light strips can be programmed to create a range of optical effects including ombre colors, music spectrum, flashing lights, solid colors, waving colors, and flickering colors.

11. The LED backlight and decorative wallboard paneling according to claim 1, wherein the rear panel is 3 mm thick.

12. The LED backlight and decorative wallboard paneling according to claim 1, wherein the frame of each LED module is 56 mm in height and 15 mm in width.

13. The LED backlight and decorative wallboard paneling according to claim 1, wherein the rear panel of each LED module is made of a sheet aluminum with high-shine aluminum facing.

14. The LED backlight and decorative wallboard paneling according to claim 1, wherein the construction wood stud frame wall has a width of 16 inches on center and a height of 36 inches on center, and is made of two by six inch cedar wood.

15. The LED backlight and decorative wallboard paneling according to claim 1, wherein each glass module has at least six sets of mounting clips.

16. A LED backlight and decorative wallboard paneling comprising:

(a) a glass module having
- (i) a clear plastic plate;
- (ii) a plethora of pebbles comprising a material selected from the group consisting of glass stones, acrylic stones, marble stones, and gems stones;
- (iii) a resin, wherein the resin is transparent, low-yellowing, and solvent-free, wherein the resin is mixed with the plethora of pebbles and applied to the clear plastic plate to form the glass module;

(b) one or more LED modules having
- (i) a frame, wherein the frame profile is 56 mm in height and 15 mm in width;
- (ii) a rear panel, wherein the rear panel comprises an aluminum sheet with high-shine aluminum facing and is 3 mm thick;
- (iii) a clear front panel;

(iv) one or more flexible LED light strips comprising light-emitting diode bulbs, wherein the one ore more flexible LED strips are mounted on a rear panel;

(v) one or more DC power and signal supply connectors; and (vi) one or more performance rubber grommets operably connected to the rear panel to protect cables or wires from sharp corners and edges, wherein each of the performance rubber grommets has a round center opening and a cutout around the outer circumference to hold the grommet in place on the rear panel; and (c) an external electrical power supply panel having (i) a power supply or driver;

(ii) a connector operably connected to the power supply or driver and the one or more flexible LED light strips;

(iii) a signal output amplifier operably connected to the one or more flexible LED light strips, wherein the one or more flexible LED light strips have programmable pixels, full color, and at least sixty LED bulbs per meter, and wherein the LED light strips can be programmed to create a range of optical effects including ombre colors, music spectrum, flashing lights, solid colors, waving colors, and flickering colors;

(iv) a wiring system operably connected to the electric power supply panel and an external light switch so that the light switch turns the LED light strips on and off;

(v) a LED controller operably connected to allow the lighting to be turned on and off and the color set over Wi-Fi from a portable electronic device, wherein the portable electronic device is a smartphone or tablet; and (vi) a stereo audio aux cable operably connected to the controller and an audio output device to allow a light display to be coordinated with music playback through the portable electronic device;

(d) a wall frame module having (i) internal slots arranged horizontally and vertically;

(ii) an LED DC power and signal supply socket integrated into the wall frame module;

(iii) six or more low profile female clips (iv) one or more aluminum spacers to space the LED modules within the wall frame module, wherein the aluminum spacers are hollow aluminum rods with four sides; and (e) a mounting system including (i) six or more low profile male clips attached to the clear plastic plate by one screw per each male clip and an epoxy glue;

(ii) the six or more low profile female clips attached to the wall frame module by one screw per each female clip and the epoxy glue, wherein the female clips and the male clips connect together to firmly attach the glass module to the wall frame module, forming sets of male and female clips with one male clip and one female clip per set, wherein each set of male and female clips has at least a 10 KG pull out load; and (iii) a sealing tape operably mounted to the front of the wall frame module to form a dust and moisture barrier between the glass module and the wall frame module that protects the LED module, wherein the one or more LED modules are located within the wall framing module, wherein the frames of the one or more LED modules slot into the internal slots arranged in the wall frame module.

17. The LED backlight and decorative wallboard paneling according to claim 16, wherein the wall frame module has a circumferential ninety-degree edge on the front.

* * * * *